United States Patent [19]

Gabriel

[11] Patent Number: 4,655,369

[45] Date of Patent: Apr. 7, 1987

[54] COIN OPERATED VENDING MACHINE FOR DISPENSING SINGLE COPIES OF A NEWSPAPER

[76] Inventor: Leon Gabriel, 915 S. Madison, LaGrange, Ill. 60625

[21] Appl. No.: 586,210

[22] Filed: Mar. 5, 1984

Related U.S. Application Data

[63] Continuation-in-part of Ser. No. 330,153, Dec. 14, 1981, abandoned.

[51] Int. Cl.[4] ..... B65H 3/22

[52] U.S. Cl. ..... 221/213; 221/231

[58] Field of Search ..... 221/213, 214, 215, 231

[56] References Cited

U.S. PATENT DOCUMENTS 2,576,636 11/1951 Opgenorth ..... 221/213

4,258,861 3/1981 Traill et al. ..... 221/213

*Primary Examiner*—Joseph J. Rolla

*Assistant Examiner*—Andrew Jones

*Attorney, Agent, or Firm*—Wm. A. Snow

[57] ABSTRACT

A machine for vending newspapers which will allow a customer to receive a single paper in a stack of papers. The papers are housed in a compartment wherein the customer places the correct change, i.e. a quarter, in the coin receptacle and shifts the same inwardly to disengage a latch mechanism and allowing the customer to pull a handle mechanism outwardly by use of pins and push plate and receive a single newspaper only. By use of a spring interiorly of the dispenser, the handle and its mechanism are returned to latched position.

9 Claims, 21 Drawing Figures

COIN OPERATED VENDING MACHINE FOR DISPENSING SINGLE COPIES OF A NEWSPAPER

This is a continuation-in-part of Ser. No. 330,153 filed Dec. 14, 1981 now abandoned.

BACKGROUND OF THE INVENTION

In the marketplace, there are newspaper coin vending machines wherein when the appropriate coin or coins are deposited, the latch on the front wall door will be unlatched and the door may be opened against a spring. However, this action exposes all of the newspapers in the machine and anyone can take as many copies as one chooses without paying for additional papers.

It was to overcome this problem that the present invention was conceived.

The known prior art is U.S. Pat. No. 4,258,861 to Traill granted Mar. 31, 1981.

SUMMARY OF THE INVENTION

A coin operated newspaper vending machine wherein when appropriate coins are deposited in a coin chute, the coins will trip a lever allowing the patron to pull a handle forwardly to shift a movable plate forwardly by use of pins and a plate to partially shift the uppermost paper only in a stack of papers in the storage compartment of the vending machine outwardly of the machine. The handle will automatically return to rest position by the action of a spring and latch the dispensing plate. The balance of the uppermost paper will then be manually removed from the machine.

DETAILED DESCRIPTION OF THE DRAWINGS

Figure 1:
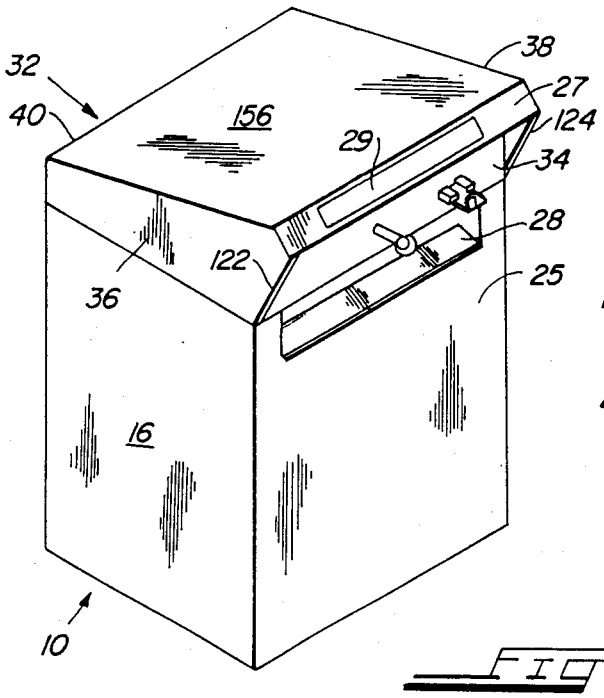
FIG. 1 is a perspective view of my new and improved dispenser.

The device of the present invention comprises a housing 10 containing a spring loaded paper storage shelf 12. The housing is provided with vertical guides 14 interior of and anchored to the side walls 16, 18 and on the rear wall 20. The springs 22 are anchored at one end to the lower end of the flange 23 and at the other end to the flange walls 24, 26 which are right angled bends on the upper end of the walls and rear walls 16, 18, respectively. The front wall 25, adjacent its upper end, is provided with an opening 28 formed by bending the upper portion of the front wall 25 inwardly and upwardly angularly as at 29 and has a U-shaped member 30 at the upper end thereof for ease in delivering a newspaper. (See FIG. 15.)

The top section 32 of the housing has front, side and end walls, 34, 36, 38 and 40, respectively.

The plate 46 is provided with pairs of rollers 48, 50, respectively, mounted adjacent its front and rear ends and along both sides thereof on which the uppermost paper slides as being dispensed. Each roller is journaled between an appropriate bracket and extends through cutouts in plate 46.

Elongated flat guide members or bars 60, 62 are positioned along the inside surface of the side walls 36, 38 and spaced above the plate 46 to retain the plate in horizontal position during sliding movement of plate 46. An elongated, transverse, rear flat member 64 has its ends bent at right angles upwardly as at 68 and welded to the inner side walls 34, 36, respectively, so as to be spaced above the side bars 60, 62. Depending from the member 64 are a pair of abutments 66 against which the plate 46 abuts at its rear end. (See FIG. 10.)

A flat crossbar 65 lies transverse to the side bars 60, 62 and is anchored at its ends to said side bars. Another longitudinally extending flat bar 72 extends between and is anchored to the bars 64 and 65. The bar 72 contains an elongated cut-away portion 74, the purpose of which will hereinafter be described.

Adjacent the rear end of plate 46 are spaced angle irons having one of the leaves 76, 78, 80, respectively, (see FIG. 6) welded to the plate 46 and the other of the leaves having apertures therein to support a shaft 84 and the four rotary members 86, 88, 90, 92, respectively, thereon. The members are secured to the shaft by Allenhead screws 94 whereby the shaft and the rotary members rotate together (see FIG. 7).

The rotary member 88 (see FIG. 9) is cut away at its lower end to form an abutment 96 and positioned in the cutaway portion 74 in bar 72. The rotary members 86, 90 and 92 each contain a bore rearward of its vertical axis for the reception of a pointed, vertically disposed rod or pin 100. The pointed pin is retained therein by Allenhead screws 101 so that the pins are adjustable vertically, with the point normally projecting downwardly below the movable plate 46 through a longitudinally extending, rectangular aperture 102 in plate 46 (see FIGS. 7 and 8) for projection in and out of a newspaper N.P. If the newspaper is thin or thick, the pins being adjustable may be adjusted to the thickness of the newspaper.

The rotary member 88 is provided with an upwardly projecting angle member 104 with one leaf 105 secured thereto with the other leaf 107 extending slightly forward and at an angle to the vertical axis of the rotary member. (See FIG. 9.)

One leg 106 of a pair of spaced right angle members is secured to the plate 46, as by welding or the like, with the other legs 110 having apertures therein to pivotally support the rear end of a shiftable lever 112 therebetween on a shaft 114. The forward end of lever 112 is bent at right angles as at 116 with the front face thereof abutting the rear face of the angular vertical member 107 on rotary member 88.

Figures 6, 6A, 7, 8, 9, 14A:
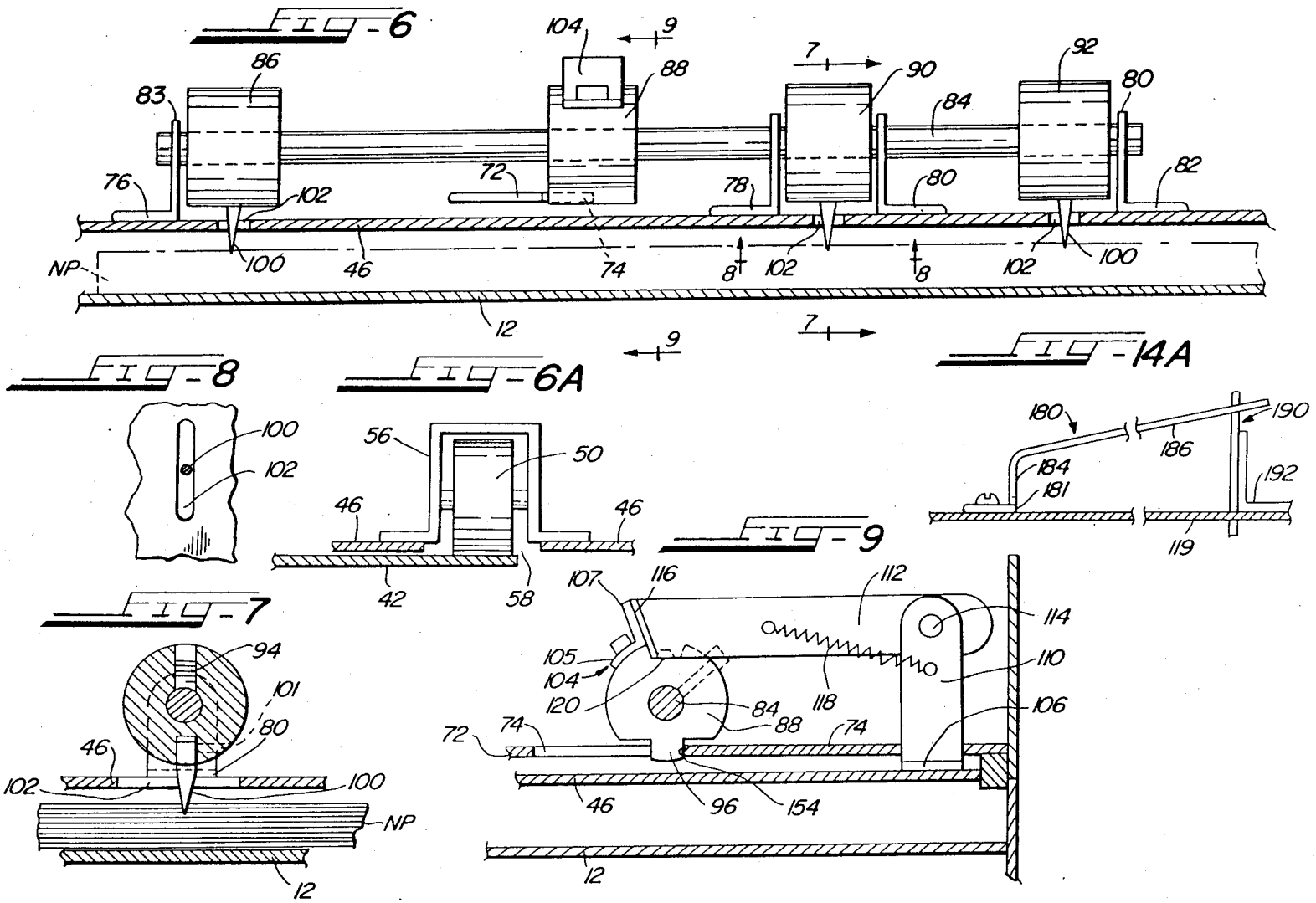
FIG. 6 is a partial cross-sectional view taken on the line 6—6 of FIG. 4.
FIG. 6A is an end view of a roller and parts are shown in cross-section taken on the line 6A—6A of FIG. 4.
FIG. 7 is a cross-sectional view taken on the line 7—7 of FIG. 6 and showing a pin penetrating a newspaper.
FIG. 8 is a plan view taken on the line 8—8 of FIG. 6 with parts in section.
FIG. 9 is a side plan view, partly in cross-section, taken on the line 9—9 of FIG. 4.
FIG. 14A is a side view of the spring for coacting with the latch for the front end of the movable plate.

The lever 112 is held in the seat 120 by a spring 118 stretching between the arm 112 and the leg 110 to urge the lever downwardly at all times and by the mating notch 120 the roller is retained thereby in the position shown in FIG. 9 in rest position, as well as to retain the pins 100, 102 in position in the uppermost newspaper.

Figure 2:
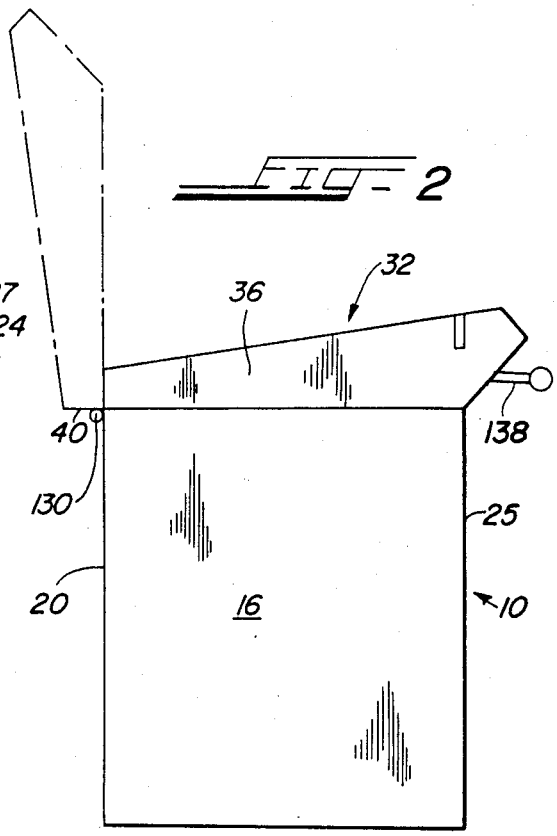
FIG. 2 is a side plan view of the device of FIG. 1 with the upper end shown in broken lines so that newspapers may be stacked in the storage compartment.
Figure 3:
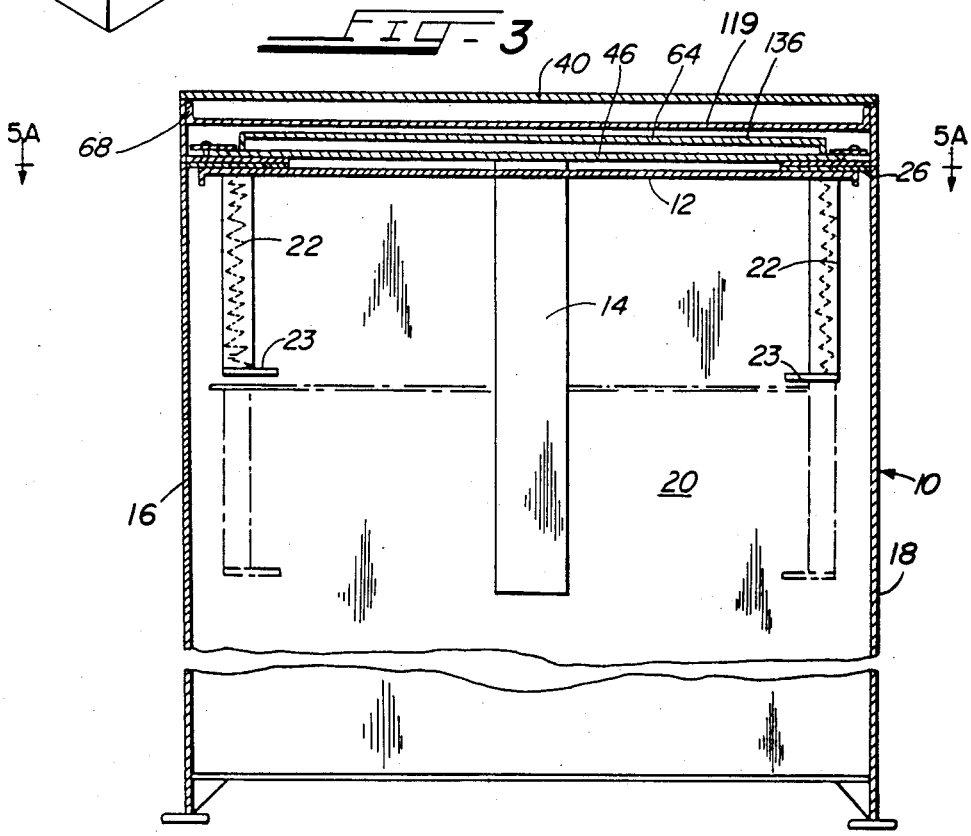
FIG. 3 is a vertical cross-sectional view taken adjacent the front wall and looking rearwardly.

The rear wall 40 of the top section 32 is hinged to the rear wall 20 of the housing 10 by spaced hinges 130. (See FIG. 2.)

The side walls 36, 38 taper upwardly forwardly from the back wall 40 and beyond the front wall 38. The forward edges of the side walls 122, 124 taper outwardly and downwardly from the top wall 156 and then downwardly and rearwardly at about 30° to meet the front lower edge of the front wall 25. The walls 34, 36, 38 and 40 are secured together by welding. The cover 156 extends between the upper ends of the side walls 36, 38 and is provided with a transparent sight opening 29.

Figure 5:
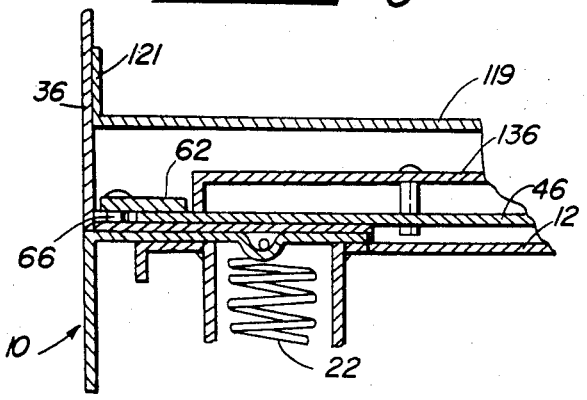
FIG. 5 is a cross-sectional view taken in the circle of FIG. 3.
Figure 5A:
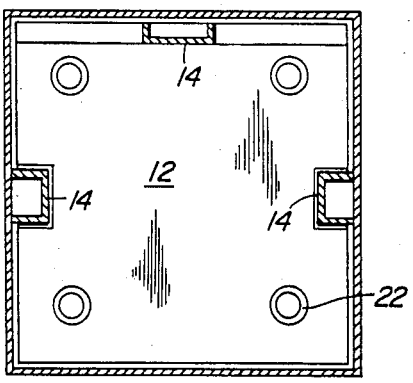
FIG. 5A is a top plan view of the paper storage compartment.

A plate 136 is spacedly secured to and is positioned above the plate 46 at its forward end (see FIG. 5) and welded thereto.

Figure 12:
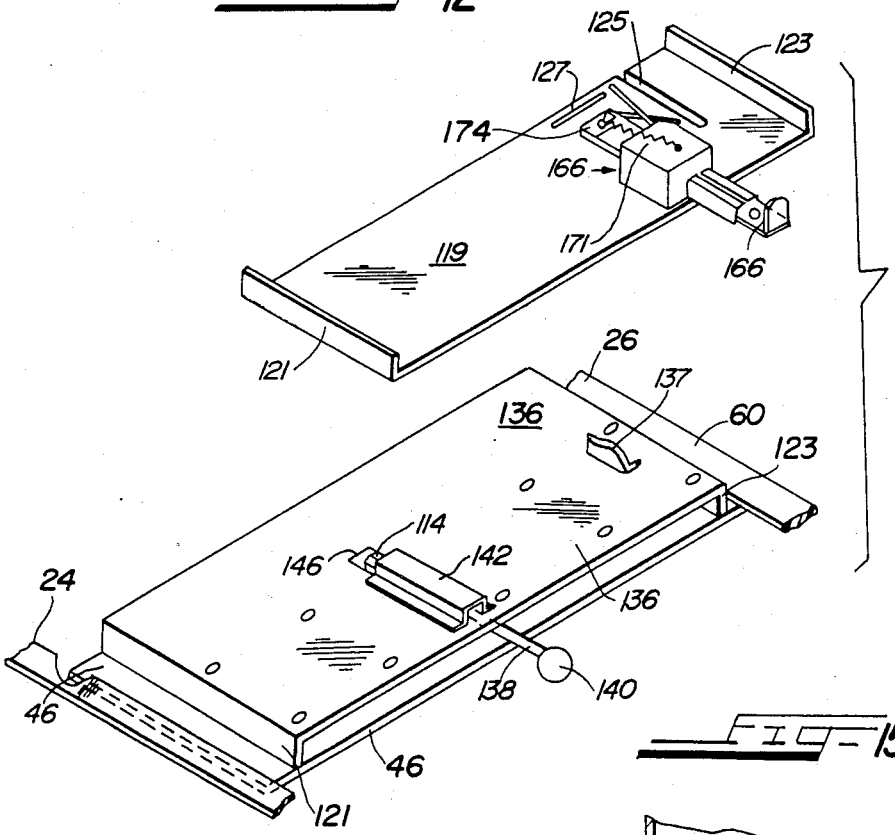
FIG. 12 is an exploded view of the coin chute and associated plate.

An elongated pull rod 138 is inserted in and through an aperture in the front wall 38 and positioned medially of the side walls 36, 38 with the forward end containing a fixed handle 140 (see FIG. 12). The other end of the rod 138 is anchored to plate 136. The rod 138 extends through an elongated, inverted, U-shaped bracket 142 which is anchored to plate 136.

An elongated spring 148 is anchored to the plate 136 at one end and the other end is anchored to the rear wall 40 so as to retain the movable plate in inoperative position and return it after the paper is removed.

Thus, when newspapers are stacked on the shelf 12, one above the other lengthwise, the weight thereof will shift the shelf 12 downwardly against the action of the springs 22. When loaded with papers, the upper section 32 is closed and locked (not shown) and the pins 100 will press into a portion of the uppermost paper N.P., i.e. adjacent the plate 46.

The sides of the papers in the stack will be positioned between the three guides 14.

Figure 15:
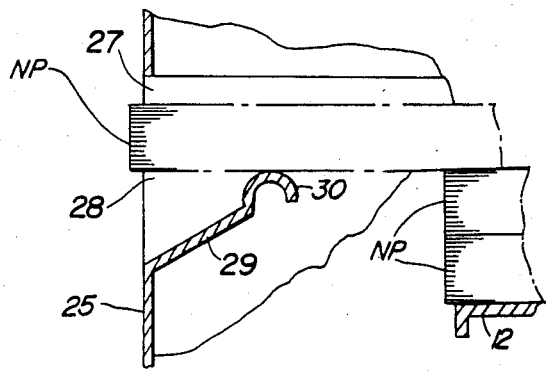
FIG. 15 is a cross-sectional view illustrating the movement of a single newspaper that has been partially moved outwardly of the cabinet.
Figure 13:
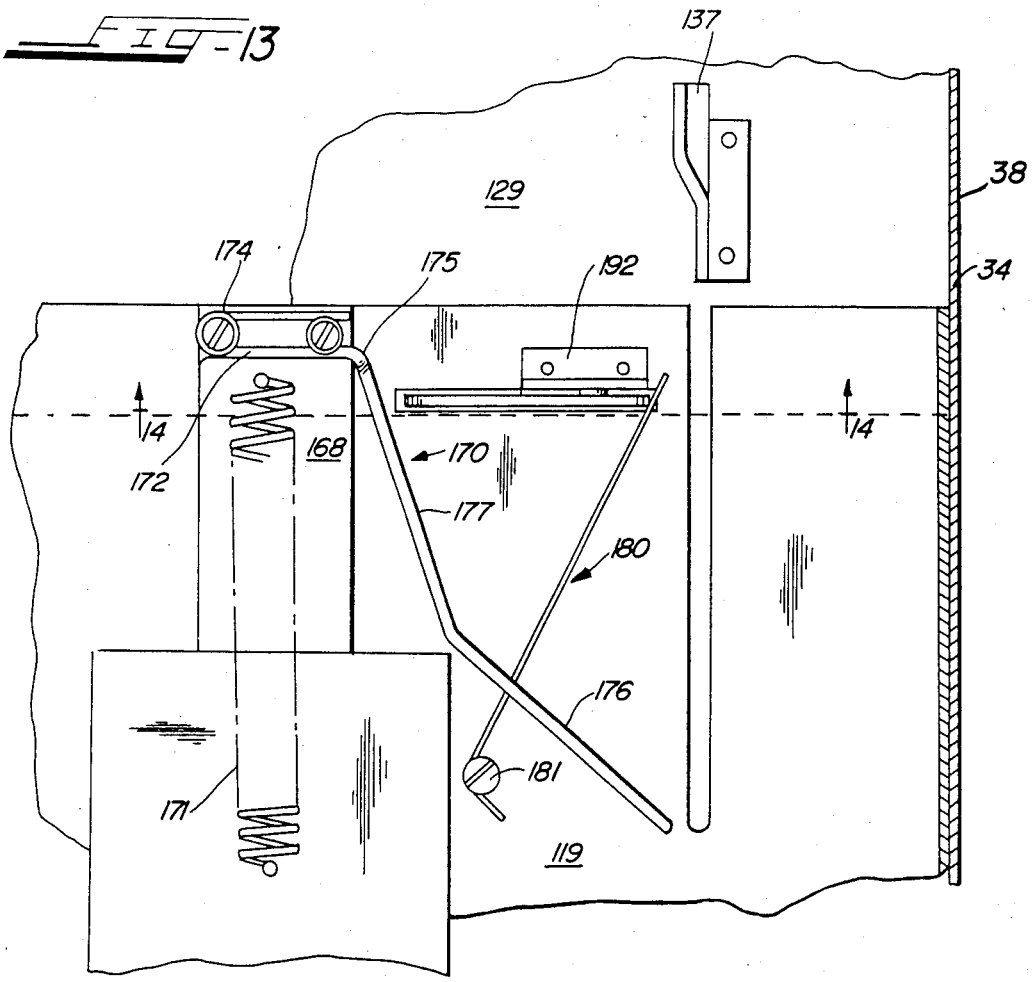
FIG. 13 is an enlarged top plan view of the flexible spring mechanism for shifting the locking lever to inoperative position.

When the handle 140 is pulled forwardly or outwardly of the housing as far as it will go, the plate 46 will also move forwardly, as the rod 138 is secured thereto, through plate 136 and the downwardly projecting pins 100 will simultaneously shift the top or uppermost paper in the stack outwardly through the opening 29 in the front wall 25 of the housing 10 and above the U-shaped member 30 as shown in FIG. 15. A series of spaced rollers 31 positioned between appropriate brackets on plate 136 assist the purchaser in removing the uppermost paper only by helping to overcome friction against the next lower paper.

The forward movement of the plate 46 is stopped when the abutment 96 on rotary member 88 abuts the front edge 154 of the cutout 74, and the rotary member 88 will rotate counterclockwise, rotating shaft 84 rotary members 86, 90 and 92 with the pins 100 shifted rearwardly of the upper newspaper. The rotary movement of the member 88 will separate the members 107, 116. The rearward movement of the plate 46 is stopped when the rear edge thereof abuts the depending abutments 66. (See FIG. 10.)

As the plate 46 returns to inoperative position under action of spring 148, the abutment 96 will abut the member 154' of the cutout 74 in bar 72 and cause rotary members 86, 90 and 92 to rotate clockwise. The pins 100 will then assume the vertical position and penetrate the uppermost newspaper by rotation of the shaft 84.

Figure 10:
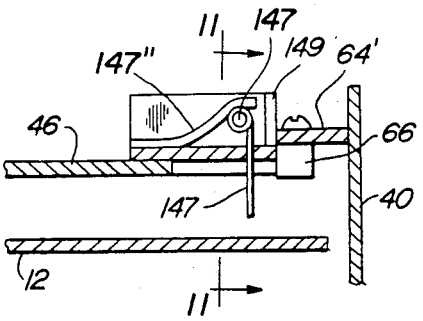
FIG. 10 is a plan view, partially in cross-section, taken on the line 10—10 of FIG. 4 illustrating one of the push plates.
Figure 11:
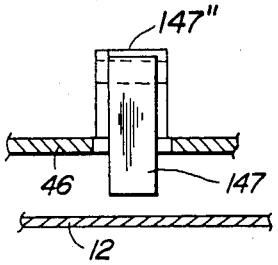
FIG. 11 is a plan view, partly in cross-section, taken on the line 11—11 of FIG. 10 to illustrate the push plate.

To assist in shifting the paper outwardly of the housing, a pair of spaced vertical pivotal plates 147 (see FIG. 10) are anchored to the brackets 149 on the rear end of the movable plate 46 which will contact and push the paper N.P. outwardly. The upper end of plate 147 is held in position by a spring seated on the upper end of plate 147 as shown in FIG. 10 as the end of the free end of the spring is radiused over the upper end of plate 147 to hold the plate in the position shown in FIG. 10 to retain the plate in the vertical position on a pivot 147' and held in position by the flat spring 147''. When the plate 46 is moved outwardly and the paper removed, the front of the next paper in the stack will cause the plate 147 to shift upwardly until the slot in plate 46 returns to its rear position, when the plate 147 will return to the vertical as seen in FIGS. 10 and 11 under action of the spring 147''.

The upper housing 32 is provided with a top wall 156.

A plate 119 has upstanding side walls 121, 123 which are anchored to the top of the plate above plate 136 and spaced therefrom and contains an elongated slot 125 and a transverse slot 127.

Appropriate locks, not shown, secure the top section 32 to the housing 10.

A coin operation consists of the usual coin mechanism anchored to plate 119 and a portion 166 extends into the exterior of the unit as is customary. The portion 168 is the movable coin chute.

A stiff, resilient spring 170 is shiftable with coin chute 168 and has a portion 172 which is attached to and depends from the rear end 174 of the coin chute.

The spring extends vertically downwardly therefrom as at 175 and then angularly forward as at 177 where a portion 176 is bent angularly therefrom sidewardly toward side wall 38.

A flexible stiff spring 180 is anchored at one end to the forward plate 119 as at 181. The spring 180 has a portion 184 extending vertically and then angularly upwardly and sidewardly as at 186 toward the side wall 38. The spring 180 cooperates in movement with the spring 170, as will hereinafter be described.

A latching lever 190 is loosely pivotally secured to a bracket 192 off-center from the ends 194, 196 whereby the end 196 is heavier than the end 194. The end 196 is arranged to seat in the seat in an elongated slot 127.

When the coin or coins are placed in the coin chute 168 and the chute is pushed inwardly, the coin or coins will drop in an appropriate coin box on the plate 119. The movable portion 168 of the coin chute moving rearwardly will cause the stiff spring 170 to contact the free end of the latch bar 194 and raise the portion 196 above the latching position. The end 180' of spring 180 will force the lower end 196 of lever 190 to partially seat on the upper surface of the plate 119 adjacent the slot 127. To release the latch 190, the curved member 137 anchored to plate 136 will move forwardly by the return of the plate 46 and contact the edge 194' and cause the latch plate 190 to drop by gravity through the slot 127 and drop the portion 196 in front of the plate 46 to prevent its forward movement with the use of a coin.

Figure 4:
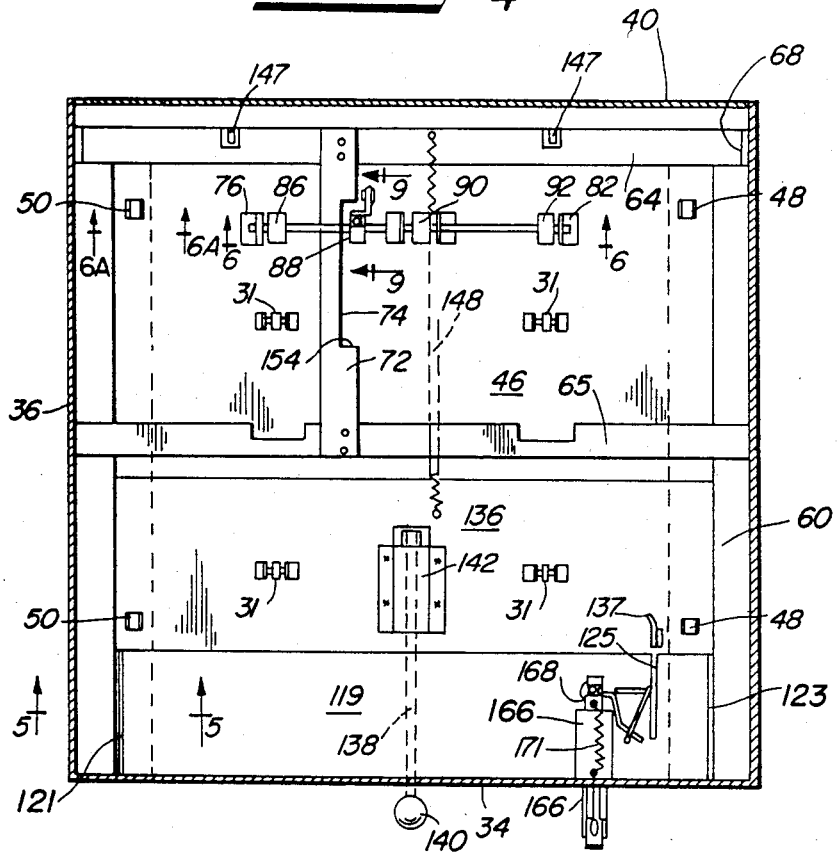
FIG. 4 is a top plan view of the mechanism as viewed from the upper end of FIG. 2.
Figure 14:
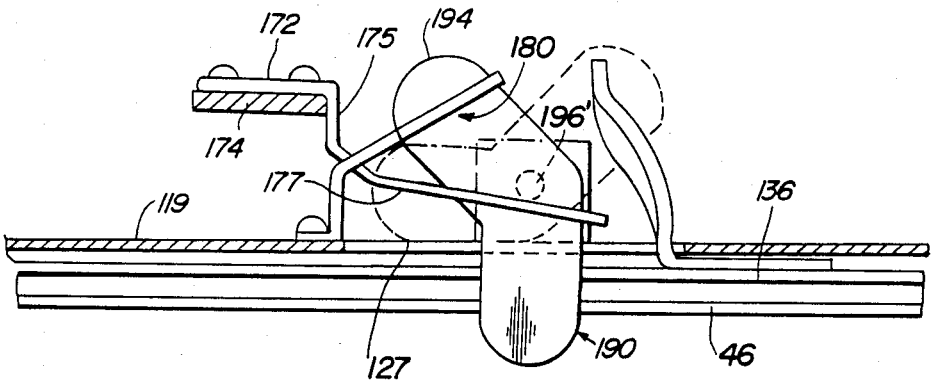
FIG. 14 is a partial cross-sectional view taken on the line 14—14 of FIG. 13.
Figure 16:
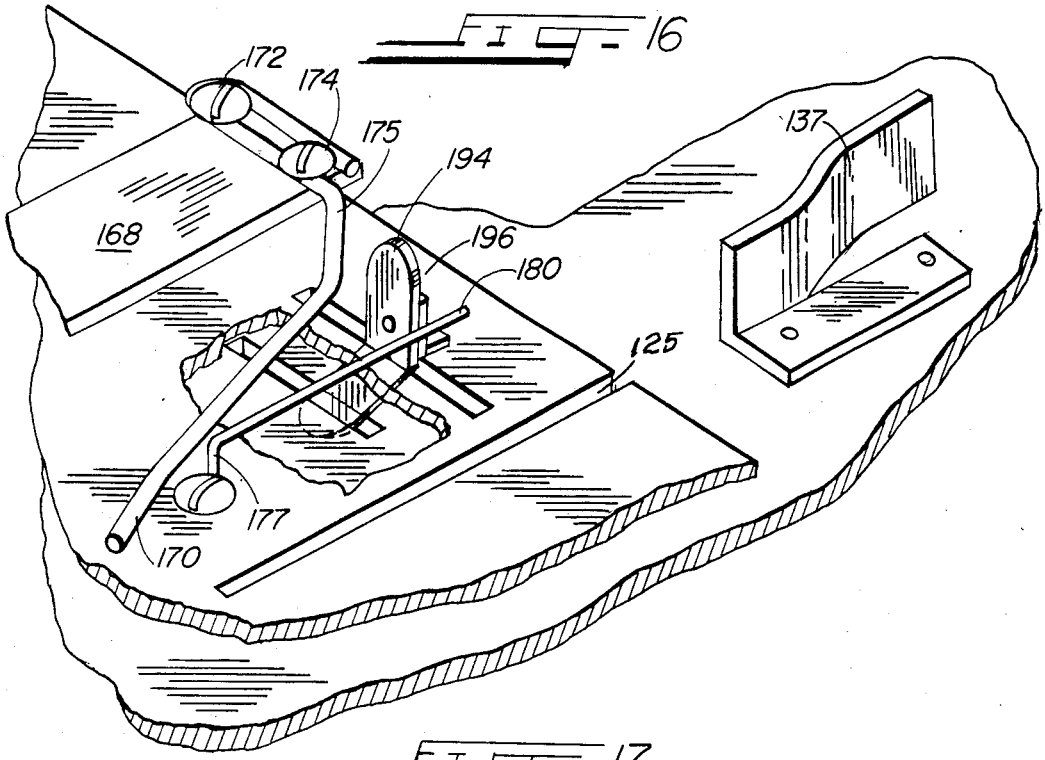
FIG. 16 is a perspective view, with parts broken away, of the latch mechanism in latched position.
Figure 17:
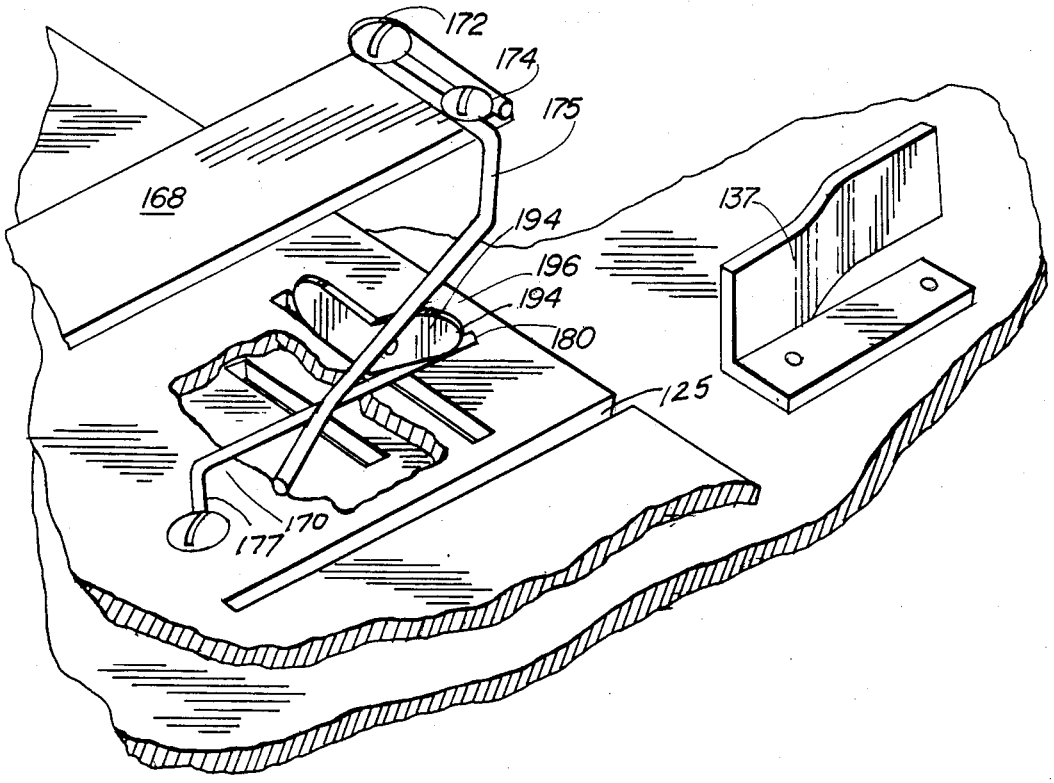
FIG. 17 is a perspective view, with parts broken away, illustrating the latch being inoperative.
Figure 18:
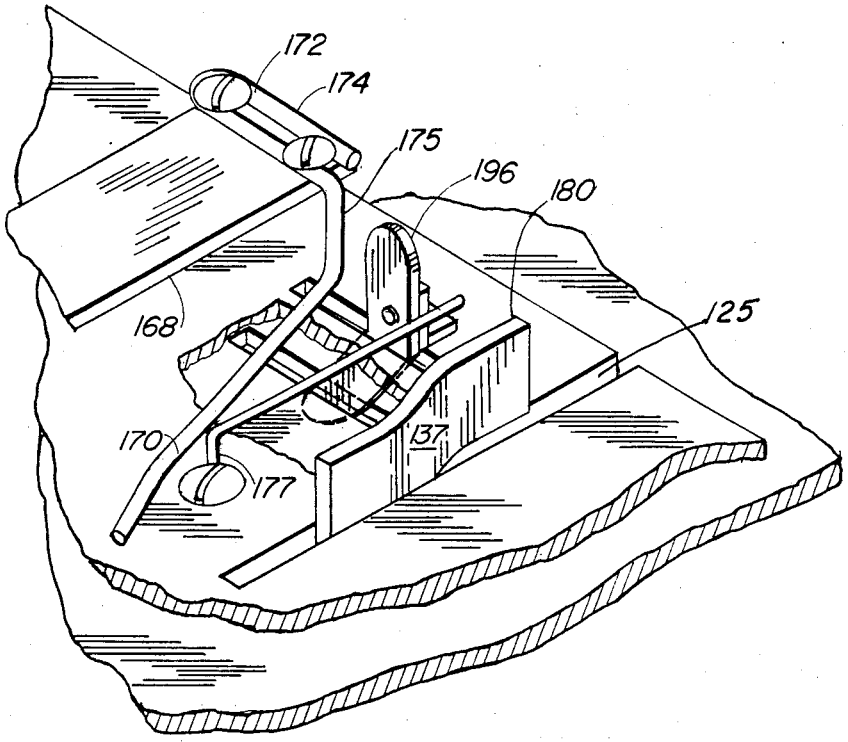
FIG. 18 is a perspective view, with parts broken away, of the latching mechanism but showing the latch being shifted to operative position.

Since the plates 46 and 136 have been pulled forwardly by the person desiring a paper, through handle 140, the forward end of the paper will project outwardly of the opening in the front wall 25 and the spring 148 will return the plate 46 to inoperative position as shown in FIG. 4. Simultaneously, the spring 171 will return the coin chute 168 to the inoperative position shown in FIGS. 12 and 14 and the lower end of lever 190 will assume the position shown in full lines in FIG. 14 to block movement of plate 46.

Although but one specific embodiment of this invention is herein shown and described, it will be understood that details of the construction shown may be altered or omitted without departing from the spirit of the invention as defined by the following claims.

I claim:

1. In a coin operated newspaper vending machine wherein only one newspaper at a time is vended having a housing, including side walls and a front and rear wall, for stacking newspapers therein between said side walls on a spring loaded plate on which a stack of newspapers is placed and for urging said papers upwardly, an upper section hingedly secured to said housing having side, front and rear walls, a horizontally movable plate in said upper section for delivering one newspaper at a time comprising means for shifting said movable plate forwardly, a portion of said means including a handle extending outwardly of the front wall of said upper section, a shaft positioned on said movable plate, a series of spaced rotary means on said shaft, depending pointed rods on said rotary means, said shaft anchored to said movable plate adjacent to a rear end thereof in a rest position, means on the shaft to partially rotate said shaft to shift said pointed rods into and out of the uppermost paper in the stack upon shifting of said movable plate, a push plate on said movable plate positioned behind said uppermost paper, a coin receiving mechanism having a shiftable coin chute therein, a stationary plate positioned above and forward of said movable plate, a transverse slot in said stationary plate, a bracket on said plate adjacent said slot, a rocker lever pivotally secured to said bracket, one end of said rocker lever removably seated in said slot to prevent forward movement of said movable plate and means associated with said coin chute to raise an end of the rocker arm out of said slot, whereby by pulling the handle forwardly, one newspaper only may be drawn outwardly of said housing.

2. The device according to claim 1 wherein a second plate is spacedly anchored to said movable plate between said movable plate and said stationary plate and is shorter depthwise than said stationary plate, an upstanding curved member on said second plate, an elongated slot in said stationary plate in which said curved member moves when said movable plate is shifted forwardly to contact said rocker arm and shifted off of said stationary plate to lock said movable plate in inoperative position.

3. The device according to claim 2 wherein the device has a transverse flat bar; a longitudinally extending flat bar is anchored at one end to said transverse plate and having a longitudinally extending cutout therein for cooperating with said means to partially rotate said rotary means on said shaft upon shifting of said plate to shift said pointed rods into and out of engagement with the uppermost paper in the stack.

4. The device according to claim 1 wherein one of said spaced rotary means on said shaft is a cylindrical roller having a depending abutment on said roller.

5. The device according to claim 1 wherein the upper end of said side walls of said housing and the lower end of said sidewalls of the upper section are provided with inwardly extending flanges, the upper section flanges seating on said housing flanges, and rollers on said movable plate for seating on said housing side wall flanges for ease in shifting said movable plate.

6. The device according to claim 1 wherein the front wall of said housing is provided with an opening through which newspapers may be projected upon forward movement of said movable plate.

7. A coin operated newspaper vending machine wherein only one newspaper is dispensed at a time comprising a deep housing having front, side and rear walls for holding a supply of newspapers, including a spring loaded plate on which the supply of newspapers is positioned urging the supply of newspapers upwardly, the upper end of said housing being open and inwardly extending flanges on the upper end of said side and rear walls, said front wall being indented adjacent to its upper end, top section comprising side, front and rear walls, said top section side wall having inwardly extending flanges, for seating on the flanges of the housing walls, a movable plate having its side edges loosely seating on the upper surface of said flanges of the upper side walls of the housing and capable of being shiftable forwardly and rearwardly, guide bars positioned above the side edges of said movable plate and secured to the flanges of said side and rear walls of said housing, a transverse bar secured to said side walls of said housing substantially medially and positioned above said movable plate, a second transverse flat bar extending between and anchored to said side walls of said housing and located adjacent to the rear end thereof, a longitudinal flat bar extending between said transverse bars and anchored thereto off center between the transverse bars, said longitudinal bar having an elongated cutout along one side, a shaft secured to and adjacent to the rear end of said movable plate, brackets supporting said shaft above the movable plate and anchored thereto, four spaced rollers spacedly secured to said shaft, adjustable pins secured to three of said rollers offset from the vertical centerline of each of said rollers, the remaining roller having a depending portion partially seated in the longitudinal bar forming means to rotate said shaft and pins whereby when said movable plate is in an inoperable position, the pins will partially penetrate the uppermost paper in the stack, a stationary plate anchored to said top section side walls and front walls and extending above said movable plate, means secured at one end to the forward end of said plate and extending outwardly of said front wall of the top section to move said movable plate from inoperative position to operative position, a coin chute secured to said front wall of said top section and extending forwardly and rearwardly of said wall, a coin receiving slot member that is manually shiftable in and out, a stiff wire, one end secured to said member and bent downwardly vertically towards said stationary plate and further then bent angularly downwardly and at the end thereof sidewardly, a flexible wire secured to said stationary plate and then bent upwardly at right angles and rearwardly, a latch lever, said lever loosely pivotally secured to a bracket substantially medially of said lever, a transverse slot in said stationary plate, one end of said lever positioned in said slot in front of said movable plate to prevent said plate from moving forwardly, a longitudinal elongated slot in said stationary plate, a curved member on said movable shelf, having an edge ending substantially 60° from the shelf, upwardly and rearwardly which strikes the upper end of said lever to close and shift it into said transverse slot.

8. The device according to claim 7 wherein an end of said flexible wire pushes a portion of said latch lever on the surface of said shelf adjacent said slot.

9. The device according to claim 8 wherein, upon depositing a coin in the coin slot and shifting the coin member rearwardly, the stiff wire will shift the latch lever from locking position upwardly out of the transverse slot.

* * * * *